US008172686B2

(12) United States Patent
Warkentin

(10) Patent No.: US 8,172,686 B2
(45) Date of Patent: May 8, 2012

(54) CONFIGURABLE WAGERING GAME MANAGER

(75) Inventor: Terry D. Warkentin, Carson City, NV (US)

(73) Assignee: WMS Gaming Inc., Waukegan, IL (US)

( * ) Notice: Subject to any disclaimer, the term of this patent is extended or adjusted under 35 U.S.C. 154(b) by 717 days.

(21) Appl. No.: 12/293,998

(22) PCT Filed: Aug. 7, 2007

(86) PCT No.: PCT/US2007/017531

§ 371 (c)(1),
(2), (4) Date: Sep. 22, 2008

(87) PCT Pub. No.: WO2008/021079

PCT Pub. Date: Feb. 21, 2008

(65) Prior Publication Data

US 2009/0264203 A1 Oct. 22, 2009

Related U.S. Application Data

(60) Provisional application No. 60/821,770, filed on Aug. 8, 2006.

(51) Int. Cl.
*A63F 9/24* (2006.01)

(52) U.S. Cl. ..... 463/42; 463/40

(58) Field of Classification Search ..... 463/42, 463/40, 25, 29

See application file for complete search history.

(56) References Cited

U.S. PATENT DOCUMENTS 4,670,857 A 6/1987 Rackman
5,116,055 A 5/1992 Tracy
5,138,712 A 8/1992 Corbin
5,280,909 A 1/1994 Tracy
5,473,143 A 12/1995 Vak et al.
5,638,448 A 6/1997 Nguyen
5,671,412 A 9/1997 Christiano
5,724,425 A 3/1998 Chang et al.
5,790,677 A 8/1998 Fox et al.
5,823,879 A 10/1998 Goldberg et al.
5,964,660 A 10/1999 James et al.
5,971,271 A 10/1999 Wynn et al.
6,035,397 A 3/2000 Campinos et al.

(Continued)

FOREIGN PATENT DOCUMENTS

WO WO-97/38540 A1 9/1997

(Continued)

OTHER PUBLICATIONS

"U.S. Appl. No. 10/788,903, Appeal Brief filed Jan. 30, 2009", 25 pgs.

(Continued)

*Primary Examiner* — Pierre E Elisca
(74) *Attorney, Agent, or Firm* — Schwegman, Lundberg & Woessner, P.A.

(57) ABSTRACT

Methods and systems for monitoring and/or servicing wagering game machines are described herein. In one embodiment, a method includes receiving a request to configure wagering game manager content, wherein the request is associated with a user identifier. The method can also include transmitting another request and the user identifier, and receiving and presenting configuration options, where the configuration options determine from which of a plurality of application servers that services can be requested. Additionally, in some embodiments, the configuration options determine separate modules for presenting information about the services. The method can also include receiving one or more configuration selections associated with the configuration options.

17 Claims, 13 Drawing Sheets

U.S. PATENT DOCUMENTS 6,058,389 A 5/2000 Chandra et al.
6,071,190 A 6/2000 Weiss et al.
6,135,887 A 10/2000 Pease et al.
6,178,510 B1 1/2001 O'Connor et al.
6,183,366 B1 2/2001 Goldberg et al.
6,189,146 B1 2/2001 Misra et al.
6,203,010 B1 3/2001 Jorasch
6,280,328 B1 8/2001 Holch et al.
6,319,125 B1 11/2001 Acres
6,358,149 B1 3/2002 Schneider
6,364,769 B1 4/2002 Weiss et al.
6,390,917 B1 5/2002 Walker et al.
6,468,155 B1 10/2002 Zucker et al.
6,508,709 B1 1/2003 Karmarkar
6,645,077 B2 11/2003 Rowe
6,682,423 B2 1/2004 Brosnan et al.
6,758,757 B2 7/2004 Luciano, Jr. et al.
6,766,305 B1 7/2004 Fucarile et al.
6,773,344 B1 8/2004 Gabai et al.
6,790,142 B2 9/2004 Okada et al.
6,811,486 B1 11/2004 Luciano, Jr.
6,830,515 B2 12/2004 Rowe
6,880,168 B2 4/2005 Maehiro
6,887,154 B1 5/2005 Luciano, Jr.
6,890,259 B2 5/2005 Breckner et al.
6,908,391 B2 6/2005 Gatto et al.
6,916,247 B2 7/2005 Gatto et al.
6,922,685 B2 7/2005 Greene et al.
6,935,958 B2 8/2005 Nelson
6,939,234 B2 9/2005 Beatty
6,945,870 B2 9/2005 Gatto et al.
RE38,812 E 10/2005 Acres et al.
6,997,803 B2 2/2006 LeMay et al.
7,025,674 B2 4/2006 Adams et al.
7,039,701 B2 5/2006 Wesley
7,043,641 B1 5/2006 Martinek
7,056,217 B1 6/2006 Pelkey et al.
7,116,782 B2 10/2006 Jackson et al.
7,117,349 B2 10/2006 Chu et al.
7,131,909 B2 11/2006 Rowe
7,159,007 B2 1/2007 Stawikowski
7,168,089 B2 1/2007 Nguyen et al.
7,179,170 B2 2/2007 Martinek et al.
7,185,342 B1 2/2007 Carrer et al.
7,186,181 B2 3/2007 Rowe
7,188,085 B2 3/2007 Pelletier
7,203,841 B2 4/2007 Jackson et al.
7,229,354 B2 6/2007 McNutt et al.
2001/0010045 A1 7/2001 Stefik et al.
2001/0014881 A1 8/2001 Drummond et al.
2001/0039210 A1 11/2001 St. Denis
2001/0044337 A1 11/2001 Rowe et al.
2001/0044339 A1 11/2001 Cordero et al.
2001/0053712 A1 12/2001 Yoseloff et al.
2002/0013174 A1 1/2002 Murata
2002/0046260 A1 4/2002 Day, II
2002/0049909 A1 4/2002 Jackson et al.
2002/0052230 A1 5/2002 Martinek et al.
2002/0107072 A1 8/2002 Giobbi
2002/0116615 A1 8/2002 Nguyen et al.
2002/0132662 A1 9/2002 Sharp et al.
2002/0143819 A1 10/2002 Han et al.
2002/0147049 A1 10/2002 Carter, Sr.
2002/0155891 A1 10/2002 Okada et al.
2002/0161868 A1 10/2002 Paul et al.
2002/0165023 A1 11/2002 Brosnan et al.
2002/0174160 A1 11/2002 Gatto et al.
2003/0004961 A1 1/2003 Slothouber et al.
2003/0061404 A1 3/2003 Atwal et al.
2003/0064771 A1 4/2003 Morrow et al.
2003/0064805 A1 4/2003 Wells
2003/0065805 A1 4/2003 Barnes, Jr.
2003/0069074 A1 4/2003 Jackson
2003/0084342 A1 5/2003 Girard
2003/0087683 A1 5/2003 Gatto et al.
2003/0088421 A1 5/2003 Maes et al.
2003/0100369 A1 5/2003 Gatto et al.
2003/0100370 A1 5/2003 Gatto et al.
2003/0100371 A1 5/2003 Gatto et al.
2003/0100372 A1 5/2003 Gatto et al.
2003/0104865 A1 6/2003 Itkis et al.
2003/0110242 A1 6/2003 Brown et al.
2003/0154216 A1 8/2003 Arnold et al.
2003/0188019 A1 10/2003 Wesley
2003/0208638 A1 11/2003 Abrams et al.
2003/0217139 A1 11/2003 Burbeck et al.
2003/0220835 A1 11/2003 Barnes, Jr.
2003/0228907 A1 12/2003 Gatto et al.
2003/0229900 A1 12/2003 Reisman
2004/0002385 A1 1/2004 Nguyen
2004/0003039 A1 1/2004 Humphrey et al.
2004/0015608 A1 1/2004 Ellis et al.
2004/0031058 A1 2/2004 Reisman
2004/0048669 A1 3/2004 Rowe
2004/0063497 A1 4/2004 Gould
2004/0087367 A1 5/2004 Hendrickson
2004/0106452 A1 6/2004 Nguyen et al.
2004/0106454 A1 6/2004 Walker et al.
2004/0127277 A1 7/2004 Walker et al.
2004/0132532 A1 7/2004 Brosnan et al.
2004/0133485 A1 7/2004 Schoonmaker et al.
2004/0142744 A1 7/2004 Atkinson et al.
2004/0152511 A1 8/2004 Nicely et al.
2004/0158471 A1 8/2004 Davis et al.
2004/0180721 A1 9/2004 Rowe
2004/0193867 A1 9/2004 Zimmer et al.
2004/0198496 A1 10/2004 Gatto et al.
2004/0229684 A1 11/2004 Blackburn et al.
2004/0235563 A1 11/2004 Blackburn et al.
2004/0242328 A1 12/2004 Blackburn et al.
2004/0242329 A1 12/2004 Blackburn et al.
2004/0242330 A1 12/2004 Blackburn et al.
2004/0242331 A1 12/2004 Blackburn et al.
2004/0243848 A1 12/2004 Blackburn et al.
2004/0243849 A1 12/2004 Blackburn et al.
2004/0248645 A1 12/2004 Blackburn et al.
2004/0266532 A1 12/2004 Blackburn et al.
2005/0020354 A1 1/2005 Nguyen et al.
2005/0027871 A1 2/2005 Bradley et al.
2005/0032577 A1 2/2005 Blackburn et al.
2005/0054445 A1 3/2005 Gatto et al.
2005/0086286 A1 4/2005 Gatto et al.
2005/0088980 A1 4/2005 Olkkonen et al.
2005/0192099 A1 9/2005 Nguyen et al.
2005/0227768 A1 10/2005 Blackburn et al.
2005/0283522 A1 12/2005 Parkkinen et al.
2006/0073887 A1 4/2006 Nguyen
2006/0142086 A1 6/2006 Blackburn et al.
2006/0143085 A1 6/2006 Adams et al.
2006/0205457 A1 9/2006 Blackburn et al.
2006/0242072 A1 10/2006 Peled et al.
2006/0276244 A1* 12/2006 Hornik et al. ..... 463/13
2006/0287098 A1 12/2006 Morrow et al.
2007/0023935 A1 2/2007 Robards et al.
2007/0026935 A1 2/2007 Wolf et al.
2007/0060355 A1 3/2007 Amaitis et al.
2007/0060358 A1 3/2007 Amaitis et al.
2007/0060381 A1 3/2007 Weiss
2007/0099697 A1 5/2007 Nelson
2007/0105613 A1 5/2007 Adams et al.
2007/0111787 A1 5/2007 Adams et al.
2007/0123332 A1 5/2007 Hishinuma et al.
2007/0123348 A1 5/2007 Nozaki
2007/0123349 A1 5/2007 Hishinuma et al.
2007/0173322 A1 7/2007 Swamy et al.
2008/0113772 A1* 5/2008 Burrill et al. ..... 463/25
2009/0069090 A1* 3/2009 Moser et al. ..... 463/42
2009/0131151 A1* 5/2009 Harris et al. ..... 463/22
2009/0253498 A1* 10/2009 Wolf et al. ..... 463/29
2010/0093440 A1* 4/2010 Burke ..... 463/42
2011/0201415 A1* 8/2011 Gagner et al. ..... 463/25
2011/0223990 A1* 9/2011 Burke et al. ..... 463/25

FOREIGN PATENT DOCUMENTS

WO WO-01/48713 A1 7/2001
WO WO-03/045516 A1 5/2003
WO WO-03/045515 A1 6/2003

| | | | |
|---|---|---|---|
| WO | WO-03/045517 | A1 | 6/2003 |
| WO | WO-03/045518 | A1 | 6/2003 |
| WO | WO-2004/004855 | A1 | 1/2004 |
| WO | WO-2006/036536 | A2 | 4/2006 |
| WO | WO-2007/061998 | A2 | 5/2007 |
| WO | WO-2007/092542 | A2 | 8/2007 |
| WO | WO-2007092608 | A2 | 8/2007 |
| WO | WO-2008/021079 | A2 | 2/2008 |

OTHER PUBLICATIONS

"U.S. Appl. No. 10/788,903, Appeal Brief filed Apr. 23, 2009", 28 pgs.
"U.S. Appl. No. 10/788,903, Examiner Interview Summary mailed Jul. 26, 2007", 1 pg.
"U.S. Appl. No. 10/788,903, Non Final Office Action mailed Jul. 22, 2009", 12 pgs.
"U.S. Appl. No. 10/813,653, Appeal Brief filed Jul. 13, 2009", 26 pgs.
"U.S. Appl. No. 10/813,653, Examiner Interview Summary mailed Jul. 26, 2007", 1 pg.
"U.S. Appl. No. 10/802,537, Examiner Interview Summary mailed Oct. 24, 2008", 4 pgs.
"U.S. Appl. No. 10/802,537, Final Office Action mailed Feb. 5, 2009", 23 pgs.
"Web Services Architecture", *W3C Working Draft*, [online]. [retrieved Jan. 21, 2009]. Retrieved from the Internet: <URL: http://www.w3.org/TR/2002/wd-WS-arch-20021114/>, (Nov. 14, 2002), 1-78.
"U.S. Appl. No. 10/629,110 Non Final Office Action mailed Jan. 24, 2007", 10 pgs.
"U.S. Appl. No. 10/629,110 Response filed Jul. 24, 2007 to Non Final Office Action mailed Jan. 24, 2007", 11 pgs.
"U.S. Appl. No. 10/629,110 Final Office Action Mailed Sep. 20, 2007", 10 pgs.
"U.S. Appl. No. 10/629,110 Response filed Feb. 20, 2008 to Final Office Action received Sep. 20, 2007", 11 pgs.
"U.S. Appl. No. 10/788,661 Final Office Action mailed Apr. 10, 2008", 21 Pgs.
"U.S. Appl. No. 10/788,661 Response filed Sep. 17, 2007 to Non-Final Office Action mailed Jun. 15, 2007", 16 pgs.
"U.S. Appl. No. 10/788,661 Restriction Requirement mailed Nov. 28, 2007", 4 pgs.
"U.S. Appl. No. 10/788,661 Non Final Office Action mailed Jun. 15, 2007", 11 pgs.
"U.S. Appl. No. 10/788,902 Final Office Action mailed May 17, 2007", 17 pgs.
"U.S. Appl. No. 10/788,902 Non Final Office Action mailed Nov. 21, 2006", 19 pgs.
"U.S. Appl. No. 10/788,902 Response filed Feb. 21, 2007 to Non Final Office Action mailed Nov. 21, 2006", 15 pgs.
"U.S. Appl. No. 10/788,902, Response filed Aug. 17, 2007 to Final Office Action mailed May 17, 2007", 13 pgs.
"U.S. Appl. No. 10/788,902, Response filed Apr. 30, 2008 to Non-Final Office Action Oct. 30, 2007", 13 pgs.
"U.S. Appl. No. 10/788,902, Non-Final Office Action mailed Oct. 30, 2007", 18 pgs.
"U.S. Appl. No. 10/788,903 Non Final Office Action mailed Jan. 3, 2007", 21 pgs.
"U.S. Appl. No. 10/788,903 Non Final Office Action mailed Jun. 28, 2007", 16 pgs.
"U.S. Appl. No. 10/788,903 Response filed Apr. 9, 2007 to Non Final Office Action mailed Jan. 3, 2007", 22 pgs.
"U.S. Appl. No. 10/788,903, Final Action mailed Dec. 31, 2007", 16 pgs.
"U.S. Appl. No. 10/788,903, Response filed Sep. 28, 2007 to Non-Final Office Action mailed Jun. 28, 2007", 13 pgs.
"U.S. Appl. No. 10/789,957 Non Final Office Action mailed May 16, 2007", 27 pgs.
"U.S. Appl. No. 10/789,957 Response filed Aug. 16, 2007 to Non Final Office Action mailed May 16, 2007", 17 pgs.
"U.S. Appl. No. 10/794,422, Response filed Nov. 19, 2007 to Non-Final Office Action mailed Jul. 18, 2007", 11 pgs.
"U.S. Appl. No. 10/794,422 Non Final Office Action Mailed Jul. 18, 2007", 9 pgs.
"U.S. Appl. No. 10/794,422 Final Office Action mailed Feb. 15, 2008", 11 pgs.
"U.S. Appl. No. 10/794,423, Response filed Nov. 20, 2007 to Non-Final Office Action mailed Jul. 20, 2007", 12 pgs.
"U.S. Appl. No. 10/794,423 Non Final Office Action Mailed Jul. 20, 2007", 10 pgs.
"U.S. Appl. No. 10/794,423, Final Office Action mailed Feb. 15, 2008", 7 pgs.
"U.S. Appl. No. 10/796,562, Non-Final Office Action mailed Nov. 27, 2007", 7 pgs.
"U.S. Appl. No. 10/802,537 Non-Final Office Action mailed May 23, 2008", 25 pgs.
"U.S. Appl. No. 10/802,537, Response filed Oct. 23, 2008 to Non Final Office Action mailed May 23, 2008", 12 pgs.
"U.S. Appl. No. 10/802,699, Non-Final Office Action mailed Sep. 27, 2007", 7 pgs.
"U.S. Appl. No. 10/802,699, Response filed Feb. 27, 2008 to Non Final Office Action mailed Sep. 27, 2007", 9 pgs.
"U.S. Appl. No. 10/802,700 Response filed Mar. 12, 2008 to Non-Final Office Action mailed Sep. 12, 2008", 8 pgs.
"U.S. Appl. No. 10/802,700, Non-Final Office Action mailed Sep. 12, 2007", 7 pgs.
"U.S. Appl. No. 10/802,701, Response filed Oct. 25, 2007 to Final Office Action mailed Jul. 25, 2007", 9 pgs.
"U.S. Appl. No. 10/802,701 Final Office Action Mailed Jul. 25, 2007", 8 pgs.
"U.S. Appl. No. 10/802,701 Non Final Office Action mailed Jan. 3, 2007", 9 pgs.
"U.S. Appl. No. 10/802,701 Response filed May 3, 2007 to Non Final Office Action mailed Jan. 3, 2007", 12 pgs.
"U.S. Appl. No. 10/802,701 Non-Final Office Action mailed Feb. 11, 2008", 13 pgs.
"U.S. Appl. No. 10/813,653 Non-Final Office Action mailed Nov. 7, 2007", 13 pgs.
"U.S. Appl. No. 10/813,653, Response filed Sep 10, 2007 to Final Office Action mailed Jun. 8, 2007", 10 pgs.
"U.S. Appl. No. 10/813,653 Final Office Action mailed Jun. 8, 2007", 11 pgs.
"U.S. Appl. No. 10/813,653 Non Final Office Action mailed Nov. 13, 2006", 10 pgs.
"U.S. Appl. No. 10/813,653 Response filed Feb. 13, 2007 to Non Final Office Action mailed Nov. 13, 2006", 13 pgs.
"U.S. Appl. No. 10/813,653, Response filed May 7, 2008 to Non-Final Office Action mailed Nov. 7, 2007", 11 pgs.
"U.S. Appl. No. 10/813,653 Final Office Action mailed Sep. 12, 2008", 12 pgs.
"U.S. Appl. No. 10/824,780 Non Final Office Action mailed May 17, 2007", 12 pgs.
"U.S. Appl. No. 10/824,780 Response filed Aug. 6, 2007 to Non Final Office Action mailed May 17, 2007", 17 pgs.
"U.S. Appl. No. 10/824,930 Final Office Action mailed Mar. 24, 2008", 17 pgs.
"U.S. Appl. No. 10/824,930, Non-Final Office Action Mailed Aug. 10, 2007", 13 pgs.
"U.S. Appl. No. 10/824,930 Response filed Dec. 10, 2007 to Office Action Mailed Aug. 10, 2007", 15 pgs.
"U.S. Appl. No. 10/824,931, Non-Final Office Action mailed Mar. 21, 2008", 13 pgs.
"U.S. Appl. No. 10/824,945 Non-Final Office Action mailed Feb. 26, 2008", 15 pgs.
"U.S. Appl. No. 11/068,065 Final Office Action mailed Jan. 9, 2008", 15 pgs.
"U.S. Appl. No. 11/068,065, Non-Final Office Action mailed Apr. 22, 2008", 16 pgs.
"U.S. Appl. No. 11/068,065, Response filed Oct. 22, 2007 to Non-Final Office action mailed May 8, 2007", 11 pgs.
"U.S. Appl. No. 11/068,065 Non Final Office Action mailed Apr. 20, 2007", 13 pgs.
"U.S. Appl. No. 11/068,065 Non Final Office Action mailed May 8, 2007", 13 pgs.
"U.S. Appl. No. 11/068,065 Response filed Apr. 9, 2008 to Final Office Action mailed Jan. 9, 2008", 11 pgs.

"U.S. Appl. No. 11/143,874, Response filed Aug. 24, 2007 to Final Office Action mailed Apr. 24, 2007", 9 pgs.
"U.S. Appl. No. 11/143,874, Response filed Feb. 12, 2008 to Non-Final Office Action Sep. 17, 2007", 12 pgs.
"U.S. Appl. No. 11/143,874 Non-Final Office Action mailed Sep. 17, 2007", 10 pgs.
"FAQs", [online]. [archived Oct. 10, 2001]. Retrieved from the Internet: <URL: http://web.archive.org/web/20011024231452/http://uddi.org/faqs.html>, 10 pgs.
"International Application Serial No. PCT/US2007/017531, International Search Report mailed Jul. 31, 2008", 2 pgs.
"International Application Serial No. PCT/US2007/017531, Written Opinion mailed Jul. 31, 2008", 5 pgs.
"UDDI: Frequently Asked Questions", © 2007 Microsoft Corporation, [online]. [retrieved Oct. 30, 2007]. Retrieved from the Internet: <URL: http://www.microsoft.com/windowsserver2003/evaluation/overview/dotnet/uddifaq.mspx>, 7 pgs.
"UDDI: Frequently Asked Questions", © 2007 Microsoft Corporation, [online]. [retrieved Feb. 5, 2008]. Retrieved from the Internet: <URL: http://www.microsoft.com/windowsserver2003/evaluation/overview/dotnet/uddifaq.mspx>, 7 pgs.
Gottschalk, K., et al., "Introduction to Web Services Architecture", *IBM Systems Journal*, 41(2), (2002), 170-177.
Ogbuji, U., "Using WSDL in SOAP Applications", *IBM developerWorks:* [online]. Retrieved from the Internet: <URL: http://web.archive.org/web/20010820205450/www-106.ibm.com/developerworks/webservices/library/ws-soap/index.html?dwzone=webservices>, (Nov. 2000), 5 pgs.
Prescod, P., "Second Generation Web Serviced", [online]. Retrieved from the Internet: <URL: http://webservices.xml.com/Ipt/a/915>, (Feb. 6, 2002), 7 pgs.
Sabbouh, M., et al., "World Wide Web Consortium", *Workshop on Web Services*, (Apr. 11-12, 2001, San Jose, CA) [online]. Retrieved from the Internet: <URL: http:/www.w3org/2001/03/WSWS-popa/paper08>, (Apr. 2001), 5 pgs.
Vasudevan, V., "A Web Services Primer", [online]. © 1998-2006 O'Reilly Media, Inc. Retrieved from the Internet: <URL: http://www.xml.com/Ipt/a/760>, (Apr. 4, 2001),10 pgs.
"U.S. Appl. No. 10/788,903, Appeal Brief filed Jun. 22, 2010", 29 pgs.
"U.S. Appl. No. 10/788,903, Non-Final Office Action mailed Sep. 16, 2010", 11 pgs.
"U.S. Appl. No. 10/802,537, Non Final Office Action mailed Mar. 29, 2011", 15 pgs.
"U.S. Appl. No. 10/802,537, Non-Final Office Action mailed Mar. 17, 2010", 25 pgs.
"U.S. Appl. No. 10/802,537, Response filed Dec. 7, 2009 to Final Office Action mailed Feb. 5, 2009", 10 pgs.
"U.S. Appl. No. 10/813,653, Examiner Answer mailed Dec. 6, 2010", 19 pgs.
Jewell, Tyler, et al., "Chapter 6, UDDI, Universal Description, Discovery and Integration", In Java Web Services, (Mar. 2002), 30 pgs.

* cited by examiner

CONFIGURABLE WAGERING GAME MANAGER

RELATED APPLICATION

This patent application is a U.S. National Stage Filing under 35 U.S.C. 371 from International Patent Application Serial No. PCT/US2007/017531, filed Aug. 7, 2007, and published on Feb. 21, 2008, as WO 2008/021079 A2, which claims the priority benefit of U.S. Provisional Patent Application Ser. No. 60/821,770 filed Aug. 8, 2006 and entitled "CONFIGURABLE WAGERING GAME MANAGER", the contents of which are incorporated herein by reference in their entirety.

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2006, 2007, WMS Gaming, Inc.

FIELD

Embodiments of the inventive subject matter relate generally to wagering game systems, and more particularly to a configurable wager gaming manager.

BACKGROUND

Wagering game machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing wagering game machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for wagering game machine manufacturers to continuously develop new games and gaming enhancements that will attract frequent play.

BRIEF DESCRIPTION OF THE FIGURES

The present invention is illustrated by way of example and not limitation in the Figures of the accompanying drawings in which.

DESCRIPTION OF THE EMBODIMENTS

This description of the embodiments is divided into five sections. The first section provides an introduction to embodiments of the invention, while the second section describes an example wagering game network. The third section describes example operations performed by embodiments of the invention and the fourth section describes an example wagering game machine. The fifth section presents some general comments.

Introduction

This section provides an introduction to some embodiments of the invention. Casino administrators are often responsible for monitoring and configuring several different types of wagering game machines, where many of the machines are made by different vendors and have different features. For example, a casino administrator may have to update pay tables on video poker machines made by company X and pay lines on video slot machines made by company Y. These updates may require services from different vendor-specific software applications, some of which may be located on remote servers. Some embodiments of the invention enable casino administrators to utilize a plurality of vendor-specific software applications through a single application interface. That is, some embodiments enable casino administrators to utilize several wagering game applications from within one application. The following discussion of FIG. 1 describes these and other features in more detail.

Figure 1:
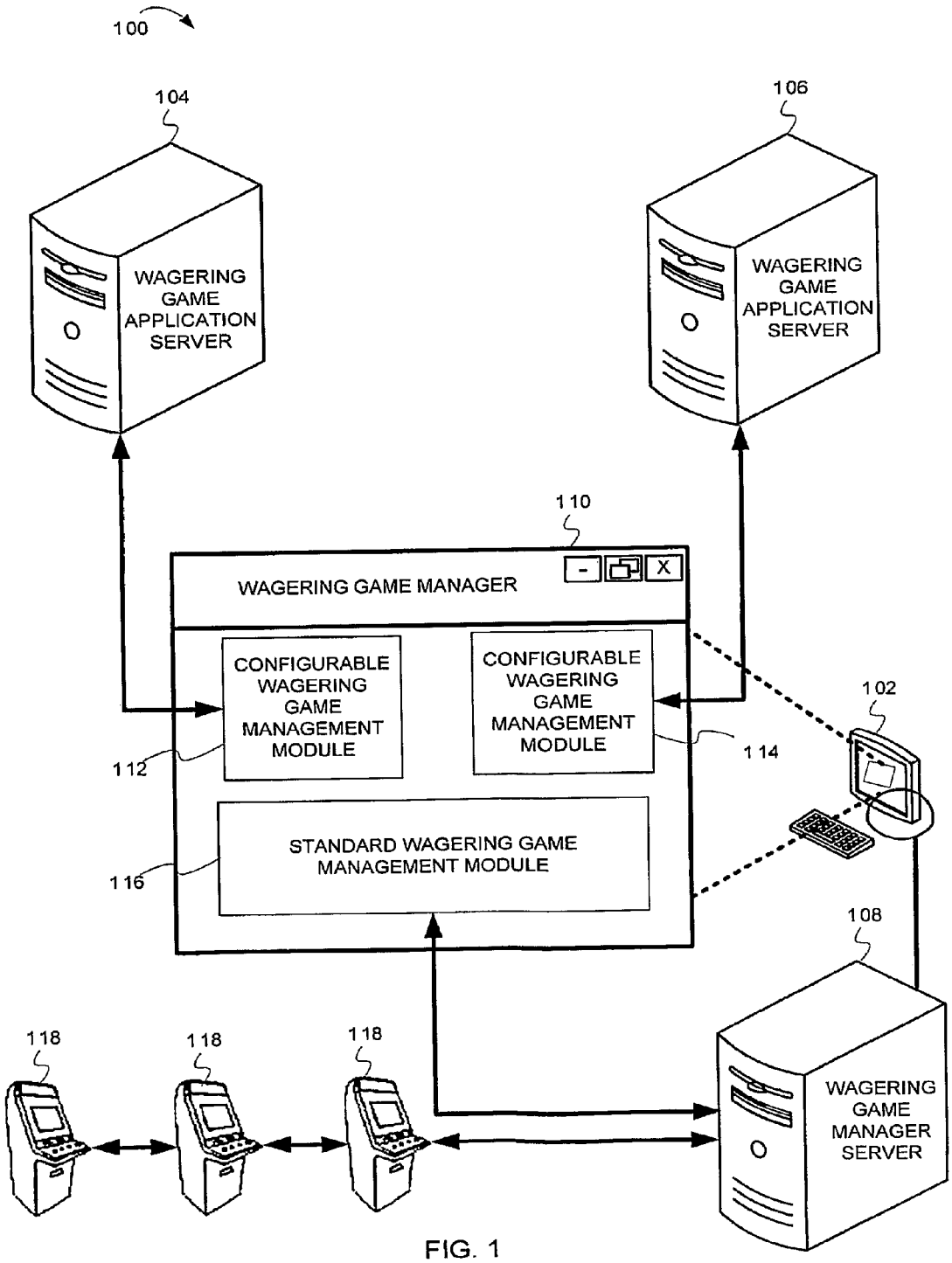
FIG. 1 is a block diagram illustrating interactions between components of a wagering game network, according to example embodiments of the invention.

FIG. 1 is a block diagram illustrating interactions between components of a wagering game network, according to example embodiments of the invention. In FIG. 1, the wagering game network 100 includes a wagering game manager server 108, administrator computer 102, wagering game application servers 104 and 106, and wagering game machines 118. The wagering game machines 118 can be of different types and from different manufacturers.

The administrator computer 102 presents a wagering game manager 110 through which an administrator can monitor, configure, update, and/or service the wagering game machines 118. The wagering game manager 110 can include a plurality of modules that enable it to acquire services from different software applications running on the wagering game manager server 108 and wagering game application servers 104 and 106. For example, one module may acquire services from a vendor-specific application program (e.g. a slot configuration application) residing on the wagering game application server 104, while another module acquires different services from another application program residing on the application server 106.

In one embodiment, each module 112, 114, and 116 of the manager 110 is appears in a separate pane (i.e., input/output area in the graphical user interface). As shown in FIG. 1, the manager 110 can acquire content/services from different servers and present the content in the modules 112, 114, and 116. In FIG. 1, the module 112 acquires content/services from application server 104, whereas the module 114 acquires content/services from application server 106, and the module 116 acquires content/services from the manager server 108. As a result, in some embodiments, administrators need only a single manager 110 to acquire and present content, services, or other information related to wagering game machines of different makes and models.

While this section has introduced some features, the following sections describe these and other features in more detail.

Wagering Game Network and Manager Architecture

This section describes a wagering game network and wagering game manager architecture, according to example embodiments of the invention.

Example Wagering Game Network

Figure 2:
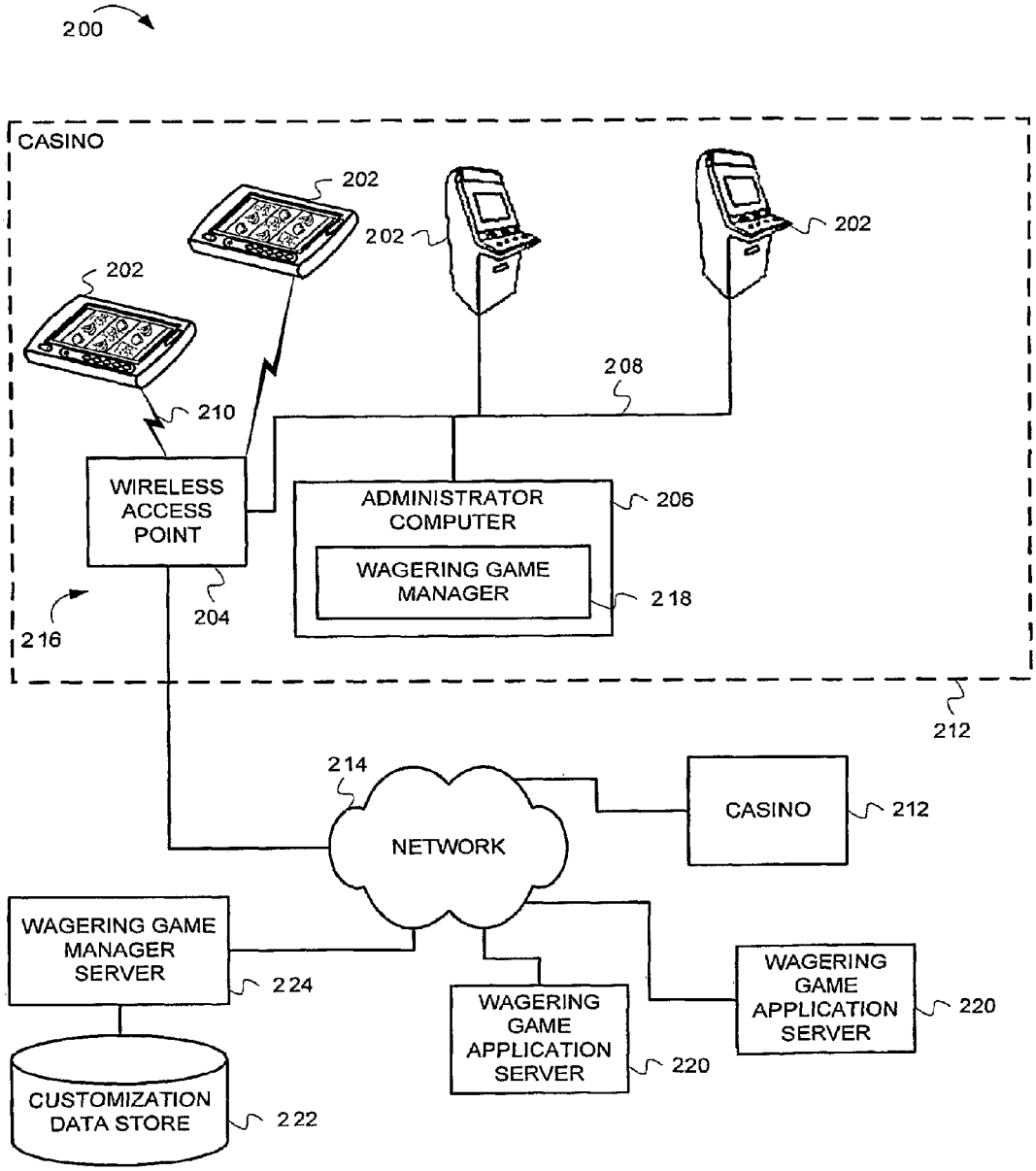
FIG. 2 is a block diagram illustrating a wagering game network, according to example embodiments of the invention.

FIG. 2 is a block diagram illustrating a wagering game network, according to example embodiments of the invention. As shown in FIG. 2, the wagering game network 200 includes a communications network 214 connected to casinos 212, wagering game application servers 220, and a wagering game manager server 224. Each of the plurality of casinos 212 includes a local area network 216, which includes a wireless access point 204, wagering game machines 202, and administrator computer 206. The wireless access point 204 communicates with the wagering game machines 202 over wireless communication links 210. The wireless access point can employ any suitable wireless technology, such as Bluetooth, 802.11, or other wireless technologies (e.g., radio technologies, optical technologies, etc.).

The administrator computer 206, which includes a wagering game manager 218, can facilitate monitoring, configuring, updating, and servicing of the wagering game machines 202. In one embodiment, the manager 218 can present information and services obtained from the wagering game manager server 224 and application servers 220 through a single interface, where the interface has separate I/O areas associated with the manager server 224. In one embodiment, the manager 218 presents content and/or service information in separate panes of a web browser.

The communications network 214 is also connected to a wagering game manager server 224 and wagering game application servers 220. The manager server 224 and application servers 220 can interact with the administrator computer's wagering game manager 218 to enable casino administrators to monitor, configure, update, and service the wagering game machines 202.

In one embodiment, any component of the wagering game network 200 (e.g., the manager 218) can be embodied as hardware, firmware, and/or software for performing the operations described herein. Any network component, such as the manager 218, can include machine-readable media including instructions for causing a machine to perform the operations described herein. Machine-readable media includes any mechanism that provides (e.g., stores and/or transmits) information in a form readable by a machine. For example, tangible machine-readable media includes read only memory (ROM), random access memory (RAM), magnetic disk storage media, optical storage media, flash memory machines, etc. Machine-readable media also includes any media suitable for transmitting software over a network.

The wagering game machines 202 described herein can take any suitable form, such as floor standing models, handheld mobile units, bartop models, workstation-type console models, etc. Furthermore, the wagering game machines 202 can be primarily dedicated for use in conducting wagering games, or they can include non-dedicated devices, such as mobile phones, personal digital assistants, personal computers, etc. In one embodiment, the wagering game network 200 can include other network devices, such as accounting servers, wide area progressive servers, player tracking servers, and/or other devices suitable for use in connection with embodiments of the invention.

Example Wagering Game Manager Architecture

Figure 3:
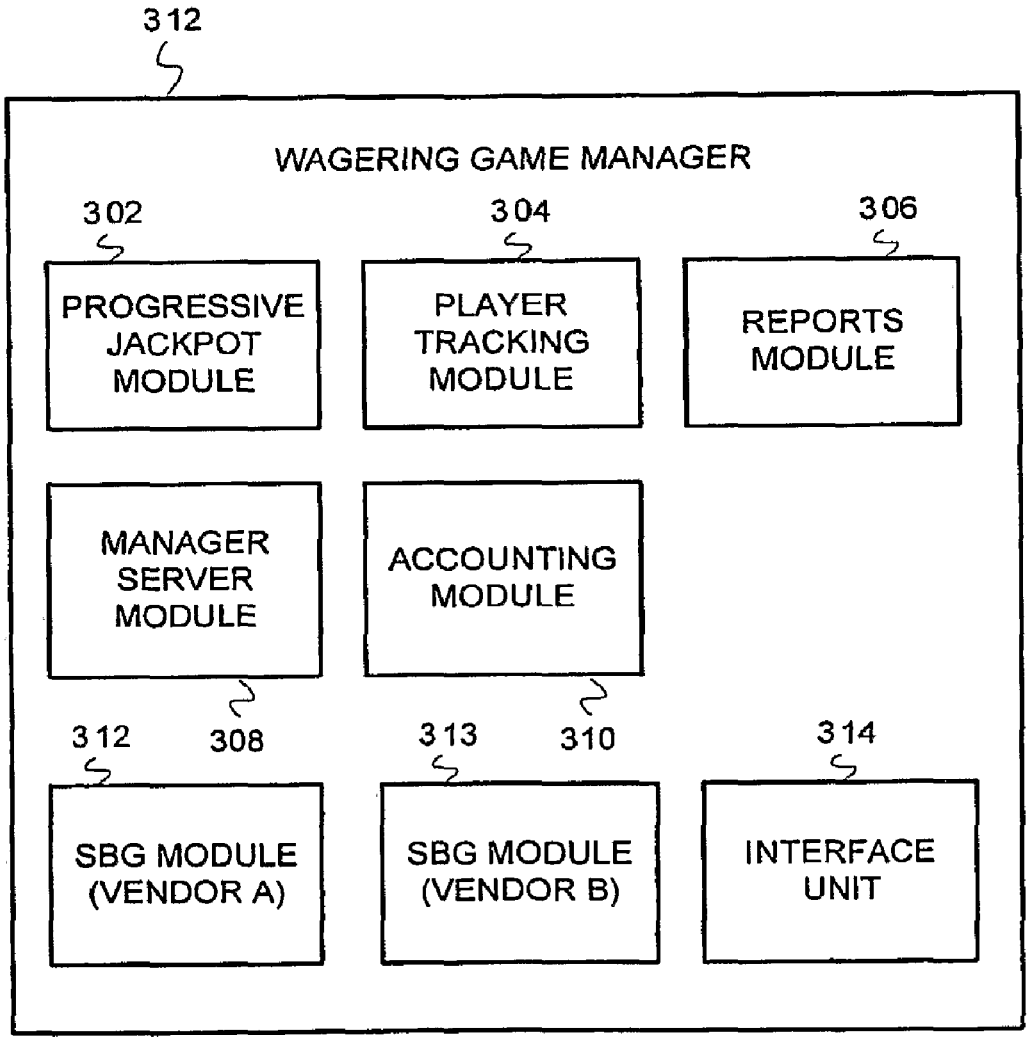
FIG. 3 is a block diagram illustrating an architecture for a wagering game manager, according to example embodiments of the invention.

FIG. 3 is a block diagram illustrating an architecture for a wagering game manager, according to example embodiments of the invention. In one embodiment, a wagering game manager can include one or more modules that acquire content and/or services from one or more application servers. In some embodiments that include a plurality of modules, the modules acquire content/services from different application servers. In FIG. 3, the manager 312 includes a progressive jackpot module 302, player tracking module 304, reports module 306, manager server module 308, accounting module 310, server-based gaming (SBG) module 312, and SBG module 313.

In one embodiment, the manager 312 initially includes only the manager server module 308, which can acquire content and/or services from the manager server 224. In some embodiments, the manager server pane 308 offers limited content and/or services. For example, the manager server 308 may offer only content and services for wagering game machines made by a particular manufacturer. However, if additional content and services are needed, the manager 312 can be configured to acquire additional content and/or services from other application servers. For example, administrators can configure the manager 312 to include the progressive jackpot module 302, player tracking module 304, reports module 306, and the accounting module 310. In another embodiment, the manager 312 can include any number of modules for acquiring content and/or services from any suitable application servers. For example, the manager 312 can add modules that monitor wagering game machine licenses, monitor progressive jackpots, facilitate distribution wagering game content, etc.

As shown in FIG. 3, the manager 312 includes two SBG modules 312 and 313, where each SBG module is associated with a different vendor. In some embodiments, each vendor-specific module monitors/services features that are particular to a specific vendor's wagering game machines. In one embodiment, the SBG module 312 can monitor and/or service server-based wagering game machines made by one vendor, whereas the SBG module 313 can do the same for machines made by company B.

The manager 312 also includes an interface unit 314, which processes input/output associated with the modules 302, 304, 306, 308, and 310. In one embodiment, the interface unit 314 can present each module's input/output in a separate pane of the manager's user interface (e.g., see FIG. 1). In one embodiment, the interface unit 314 presents content by rendering web page content, received from an application server, in the manager's user interface.

Example Operations

This section describes operations performed by embodiments of the invention. In the discussion below, the flow diagrams will be described with reference to the block diagrams presented above. In certain embodiments, the operations are performed by executing instructions residing on machine-readable media (e.g., software), while in other embodiments, the operations are performed by hardware and/or other logic (e.g., firmware). In some embodiments, the operations are performed in series, while in other embodiments, one or more of the operations can be performed in parallel.

Figure 4:
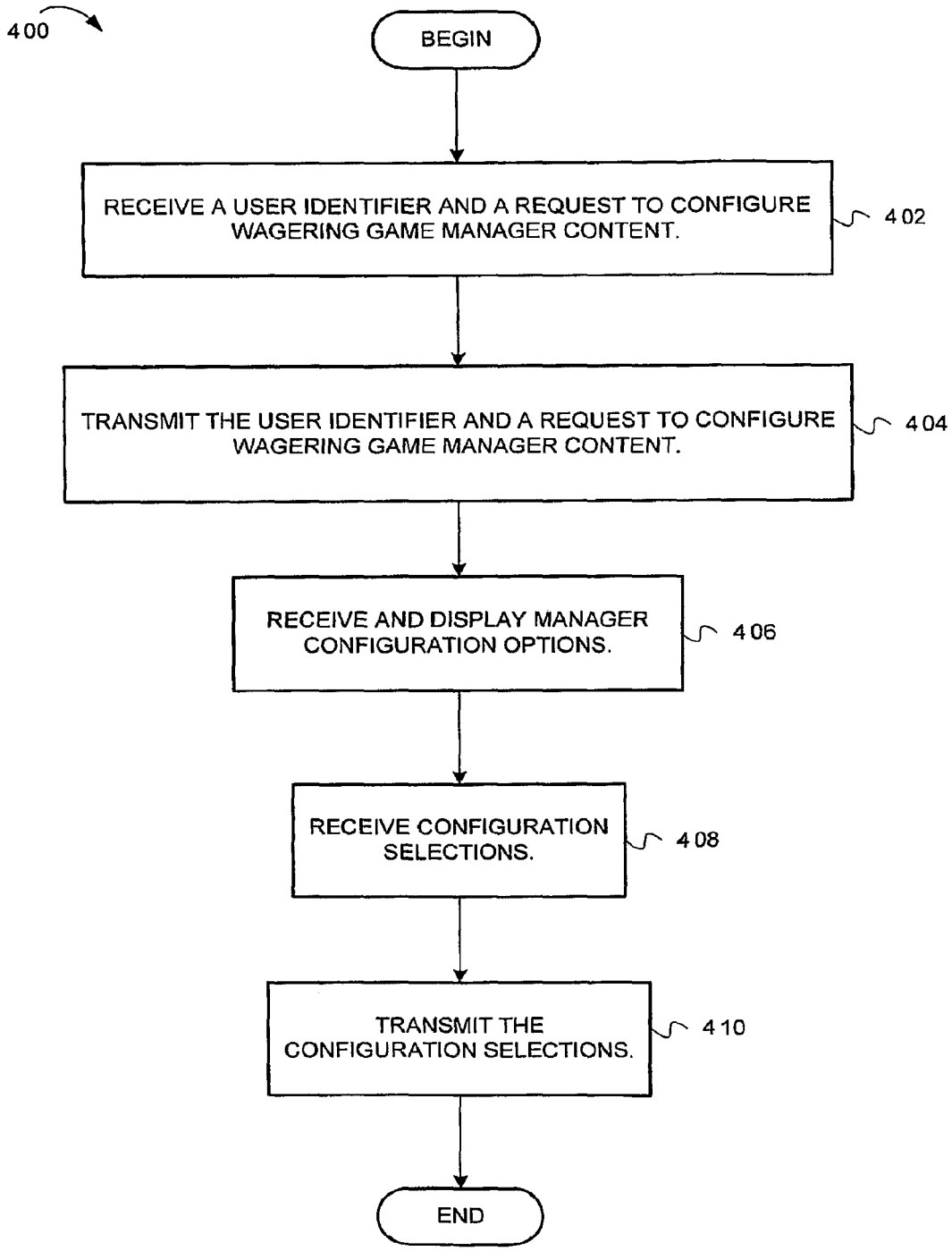
FIG. 4 is a flow diagram illustrating operations for configuring a wagering game manager, according to example embodiments of the invention.
Figure 5:
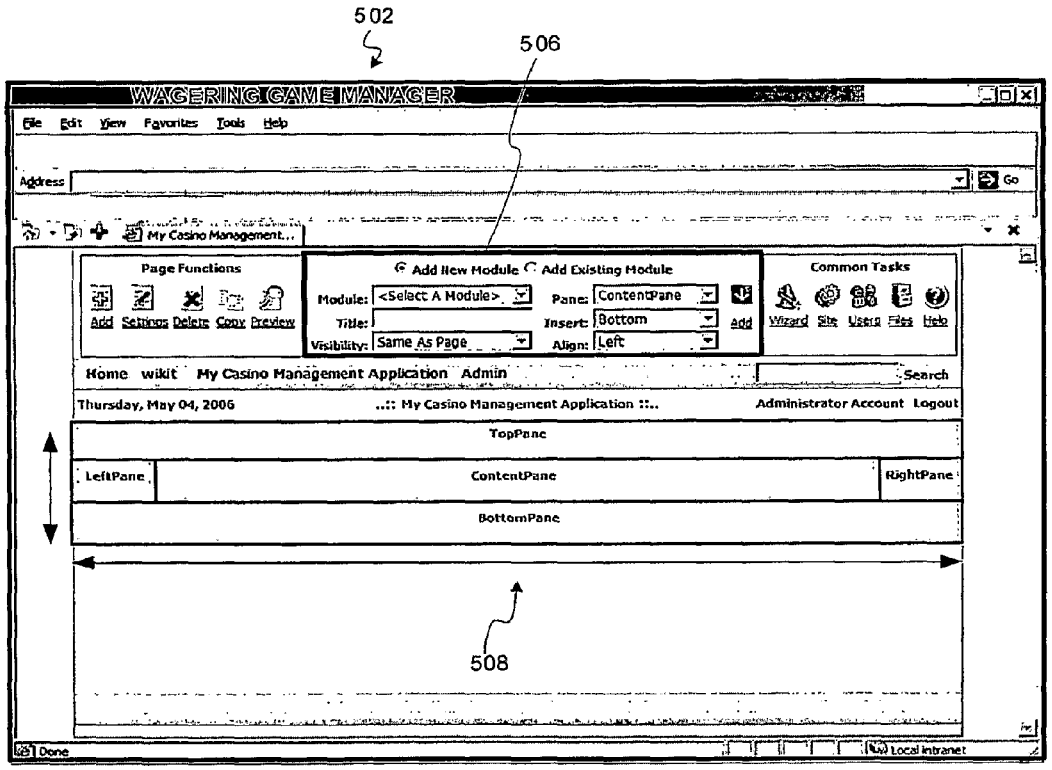
FIG. 5 is a block diagram illustrating an interface to a wagering game manager, according to example embodiments of the invention.
Figure 6:
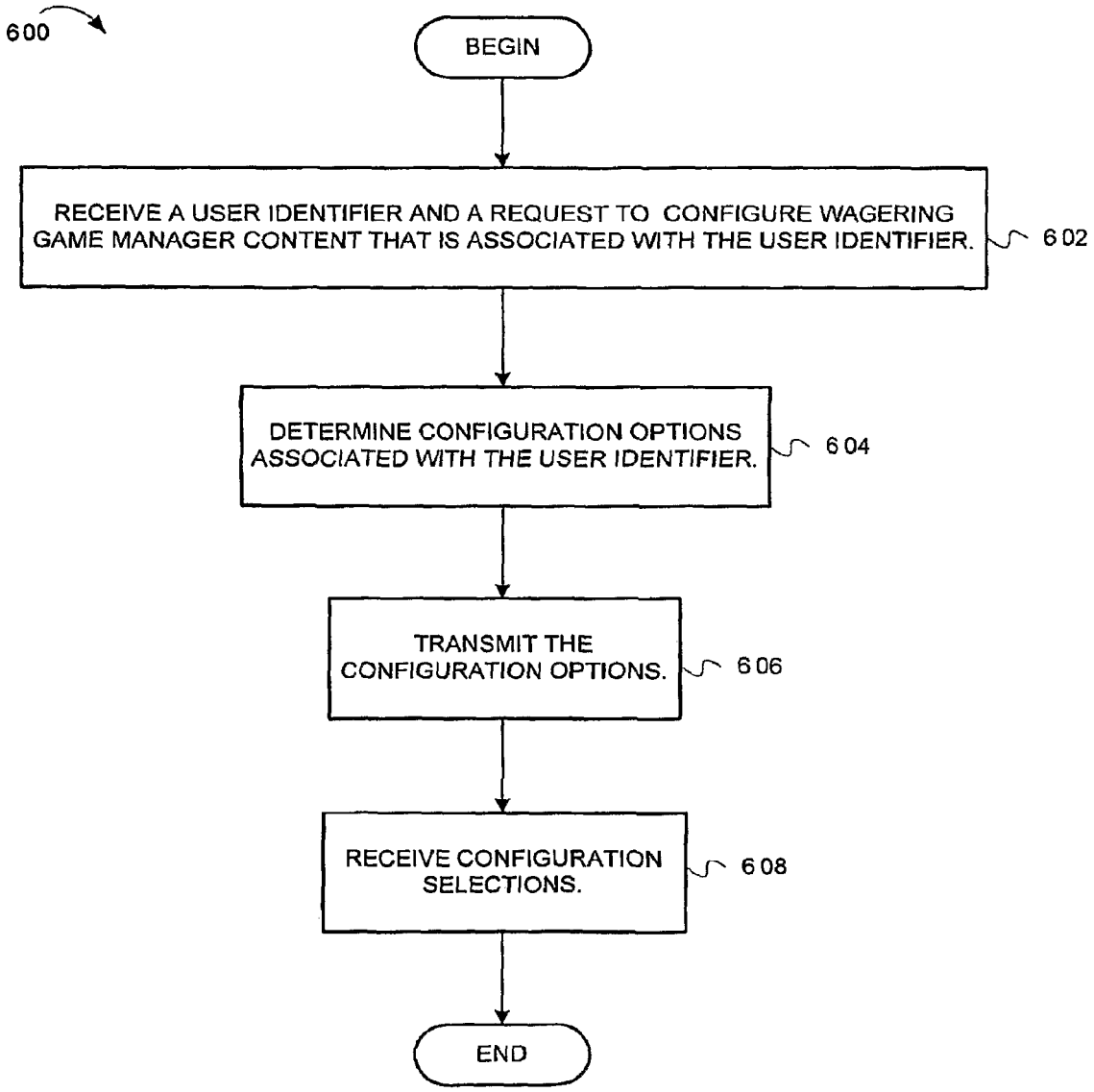
FIG. 6 is a flow diagram illustrating operations for receiving and processing configuration selections associated with wagering game managers, according to example embodiments of the invention.

This section presents FIGS. 4-10. FIGS. 4-6 describe example operations for configuring a manager, while FIGS. 6-10 describe example operations performed during execution of a manager. This section continues with a discussion of FIG. 4.

FIG. 4 is a flow diagram illustrating operations for configuring a wagering game manager, according to example embodiments of the invention. The flow diagram 400 begins at block 402.

At block 402, a manager 218 receives a user identifier and a request to configure content for the manager 218. The manager's content can be configured with respect to source, subject matter, format, or in any other suitable fashion. In one embodiment, the content defines one or more modules that are presented by the manager 218. The manager 218 can reside in the administrator computer 206, or it can reside in a wagering game machine 202 or other network device. The flow continues at block 404.

At block 404, the manager 218 transmits, to a wagering game manager server 224, the user identifier and a request to configure content for the manager 218. The flow continues at block 406.

At block 406, the manager 218 receives a set of configuration options from the manager server 224 and displays them on the administrator computer 206. In one embodiment, the manager 218 includes a web browser for displaying the configuration options. In another embodiment, the manager 218 presents a configuration wizard that presents the configuration options and receives configuration selections.

The configuration options can include a list of available modules, module placement options, color options, text size options, source and subject matter options, options to receive periodic updates, or any other suitable options. In one embodiment, the configuration options can have default settings. For example, there may be default module selections and placement, colors, and text size.

FIG. 5 describes an example interface employed by one embodiment of a wagering game manager. The discussion will continue with FIG. 5 and then come back to FIG. 4.

FIG. 5 is a block diagram illustrating an interface to a wagering game manager, according to example embodiments of the invention. In FIG. 5, an interface 502 to a wagering game manager includes menus 506 for configuring modules that present information and services received from manager servers and application servers. In one embodiment, as more modules are added, the manager 218 can acquire more services from different application servers 220, providing users with greater power and flexibility in monitoring, configuring, updating, and servicing the wagering game machines 202.

In one embodiment, a plurality of modules can be configured to appear in the panes 508 or anywhere in the interface 502. The discussion will now turn back to FIG. 4.

At block 408, the manager 218 receives configuration selections. For example, the manager 218 receives menu selections from a user (e.g., through the interface 502), where the menu selections indicate modules that will be used with the manager 218 and placement information indicating a layout for the modules, etc. The flow continues at block 410.

At block 410, the manager 218 transmits the configuration selections to the manager server 224 for storage and later use. From block 410, the flow ends.

This section continues with a discussion of how embodiments of the manager server 224 can process configuration selections received from the manager 218.

FIG. 6 is a flow diagram illustrating operations for receiving and processing configuration selections associated with a wagering game manager, according to example embodiments of the invention. The flow diagram 600 begins at block 602.

At block 602, the manager server 224 receives a user identifier and a request to configure wagering game manager content that is associated with the user identifier. The flow continues at block 604.

At block 604, the manager server 224 determines configuration options associated with the user identifier. In one embodiment, different configuration options are available based on various parameters. For example, configuration options availability may be determined based on licensing agreements, regulatory jurisdictions, casino affiliations, user affiliations, system requirements, etc. The flow continues at block 606.

At block 606, the manager server 224 transmits the configuration options to the manager 218. The flow continues at block 608.

At block 608, the manager server 224 receives configuration selections from the manager 218, where the configuration selections were chosen from the configuration options transmitted at block 606. In one embodiment, the configuration selections specify a set of modules for use with the manager 218. The manager server 224 can save the configuration selections for future use. From block 608, the flow ends.

While FIGS. 4-6 describe operations for configuring a wagering game manager, this section continues with a discussion how embodiments of the manager can obtain and present information and services acquired from application servers.

Figure 7:
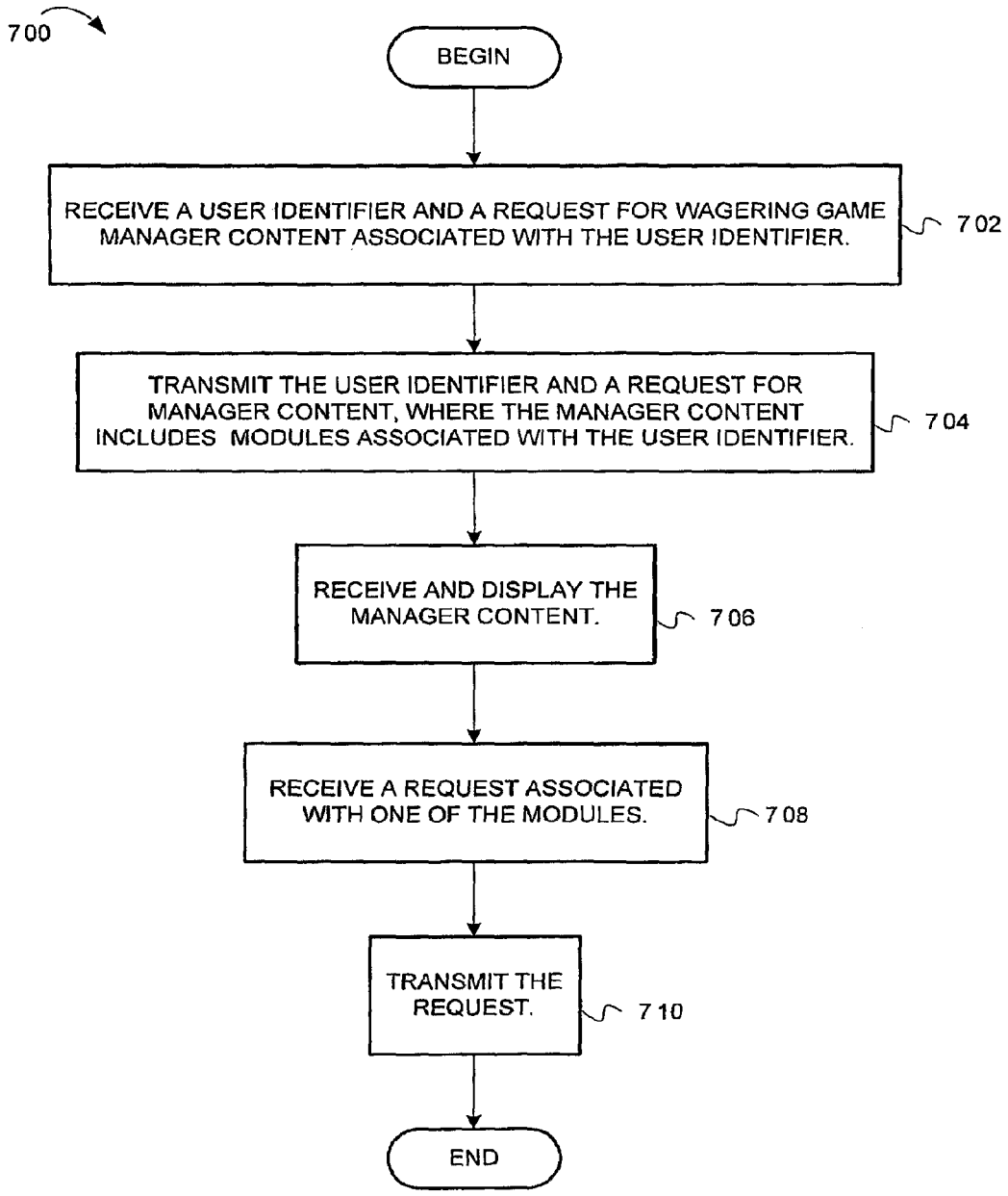
FIG. 7 is a flow diagram illustrating operations for obtaining user-selected settings and services, according to example embodiments of the invention.

FIG. 7 is a flow diagram illustrating operations for obtaining user-selected settings and services, according to example embodiments of the invention. The flow diagram 700 begins at block 702.

At block 702, the manager 218 receives a user identifier and a request for content that is associated with the user identifier. The flow continues at block 704.

At block 704, the manager 218 transmits the user identifier and a request for the content to the manager server 224. In one embodiment, the content includes modules associated with the user identifier. The flow continues at block 706.

At block 706, the manager 218 receives and displays the content. In one embodiment, the content can include hypertext markup language (HTML), extensible markup language (XML), or any other suitable markup language. As noted above, the content can include modules to be used in the manager 218.

Figure 8:
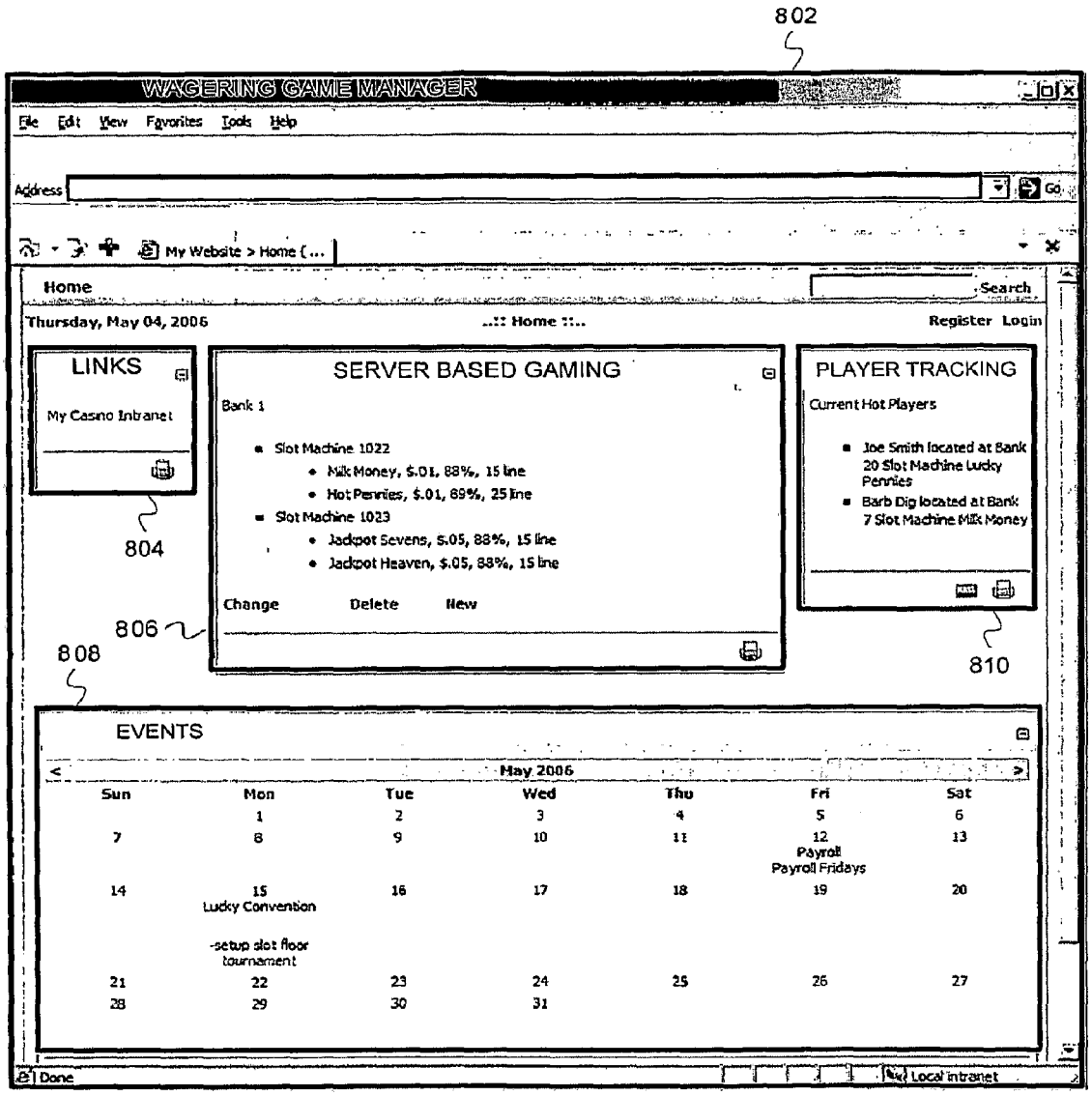
FIG. 8 is a block diagram illustrating how a wagering game manager can present content, according to example embodiments of the invention.

FIG. 8 shows one example of how a manager can present the content. The discussion will continue with FIG. 8 and then turn back to FIG. 7.

FIG. 8 is a block diagram illustrating how a wagering game manager can present content, according to example embodiments of the invention. In the embodiment shown in FIG. 8, the interface 802 is part of a manager that can interact with remote software applications (e.g. applications residing on the application servers 220) to acquire services for tracking players, monitoring server-based wagering game machines, and monitoring upcoming events. In one embodiment, the manager 802 presents different services in different modules of the manager's graphical user interface 702. In FIG. 8, the modules include a server-based gaming module 806, player tracking pane 810, events pane 808, and links pane 804. Because embodiments of the wagering game manager include a plurality of modules for presenting content associated with a plurality of services, users need only open one manager to obtain a plurality of services. Referring back to FIG. 7, the flow diagram 700 continues at block 708.

At block 708, the manager 218 receives a request associated with one of the modules. In one embodiment, the manager 218 receives the request through one of its modules (e.g., see 804, 806, 808, or 810), where the request specifies desired services and/or content. For example, a manager 218 can receive, through its server-based gaming module 806, a request to monitor a currently unmonitored slot machine. The flow continues at block 710.

At block 710, the manager 218 transmits the request to an application server 220. For example, a module of the manager 218 requests that a remote application running on an application server 220 return information about the unmonitored slot machine. From block 710, the flow ends.

Figure 9:
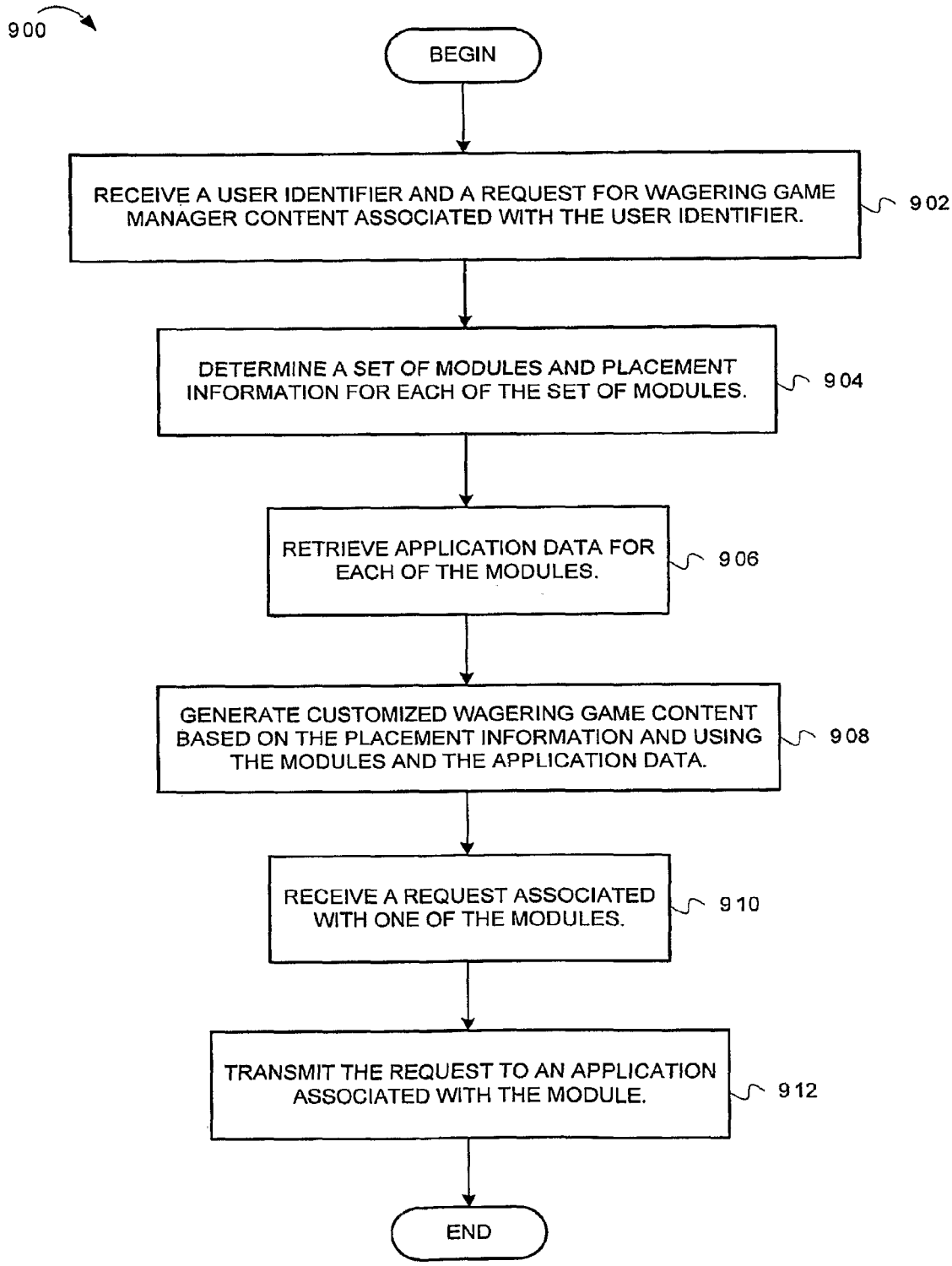
FIG. 9 is a flow diagram illustrating operations for providing configuration settings associated with a wagering game manager, according to example embodiments of the invention.

This section continues with a discussion of FIG. 9, which describes how some embodiments of a manager server can respond to requests for a manager's configuration settings.

FIG. 9 is a flow diagram illustrating operations for providing configuration settings associated with a wagering game manager, according to example embodiments of the invention. The flow diagram 900 begins at block 900.

At block 902, a manager server 224 receives, from a manager 218, a user identifier and request for content associated with the user identifier. The flow continues at block 904.

At block 904, the manager server 224 determines a set of modules and placement information associated with the modules. In one embodiment, the modules and placement information are determined based on configuration selections associated with the user identifier. The flow continues at block 906.

At block 906, if needed, the manager server 224 obtains any needed application data for the modules. For example, if a module is configured to fetch real-time meter data from a set of the wagering game machines 202, the manager server 224 requests and receives the meter data from an application server 220 that tracks the meter data. The flow continues at block 908.

At block 908, the manager server 224 generates content based on the modules, placement information, and application data. In one embodiment, the manager server 224 generates a web page including the modules and application data, where the modules will be rendered according to the placement information. The flow continues at block 910.

At block 910, the manager server 224 receives a request associated with one of the modules. For example, referring to FIG. 8, the manager server 224 receives, through the manager's player tracking module 810, a request to track specific players. In one embodiment, player tracking services are performed by software residing on an application server 220. The flow continues at block 912.

At block 912, the manager server 224 transmits the request to an application server 220 that includes software for responding to the request. In one embodiment, the application server 220 responds directly to the manager 218, whereas in other embodiments, the application server 220 responds to the manager server 224, which forwards any necessary information to the manager 218. From block 912, the flow ends.

While FIG. 9 described operations of manager servers, this section continues with a discussion of how embodiments of the wagering game application server can respond to service/content requests.

Figure 10:
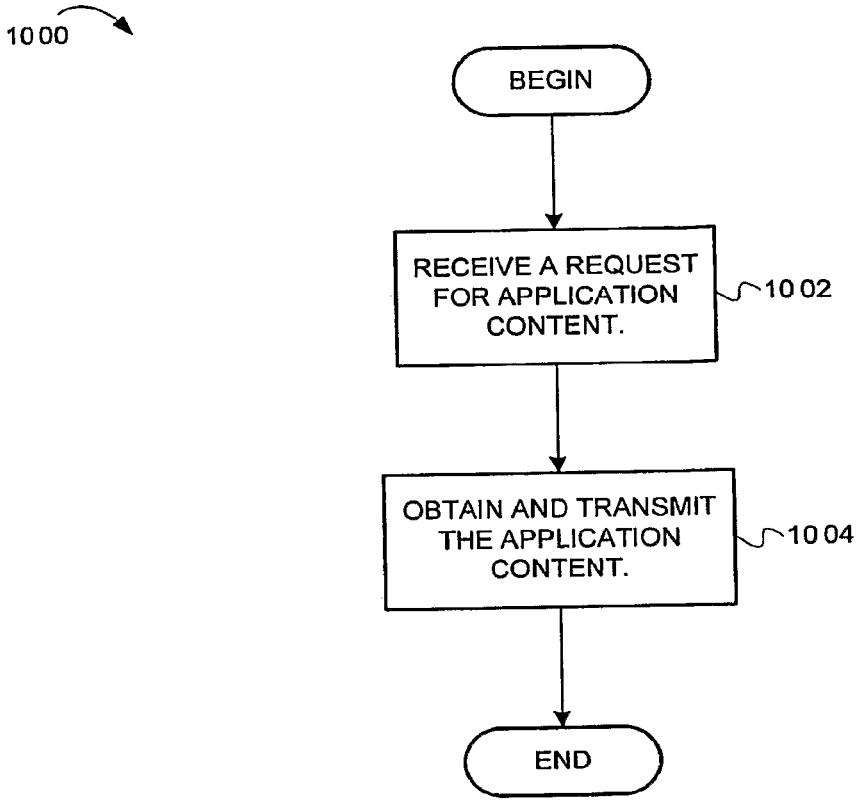
FIG. 10 is a flow diagram illustrating operations for providing content and/or services in response to a request associated with a wagering game manager, according to example embodiments of the invention.

FIG. 10 is a flow diagram illustrating operations for providing content and/or services in response to a request associated with a wagering game manager, according to example embodiments of the invention. The flow 1000 begins at block 1002.

At block 1002, an application server 220 receives a request for content and/or services, where the request is associated with a manager 218. For example, the application server 220 receives a request to monitor players on the local area network 216. The request can originate at the manager server 224 or the manager 218. The flow continues at block 1004.

At block 1004, the application server 220 obtains the content and/or performs the services. Additionally, the application server 220 transmits content or service information destined for the manager 218. For example, the application server 220 obtains player tracking information and transmits it to the manager 218. From block 1004, the flow ends.

Figure 11:
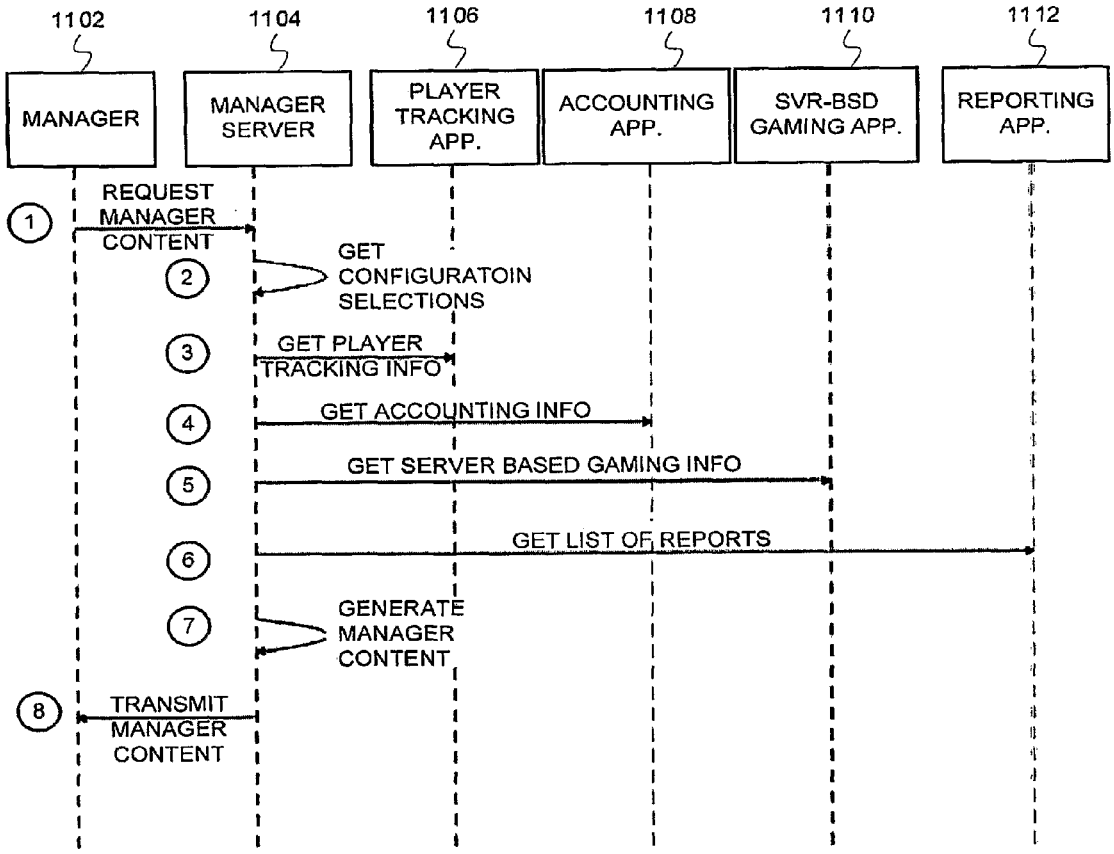
FIG. 11 is a sequence diagram illustrating interactions between wagering game network components, where the interactions described how an embodiment of the wagering game manager can acquire services from network components.

This section continues with yet another embodiment of a wagering game network. FIG. 11 is a sequence diagram illustrating interactions between wagering game network components, where the interactions describe how embodiments of the wagering game manager can acquire services from remote applications. The interactions occur in eight stages.

At stage one, the manager 1102 requests content from the manager server 1104. At stage two, the manager server 1104 determines configuration selections associated with the manager 1102. In one embodiment, the configuration settings indicate one or more modules to be included in the content, where the modules acquire content/services from the player tracking application 1106, accounting application 1108, server-based gaming application 1110, and reporting application 1112. In one embodiment, the applications can be stored on application servers that are remote to the manager server 1104 (e.g., see FIG. 2).

At stage three, the manager server 1104 acquires player tracking information from the player tracking application 1106. At stages four, five, and six, the manager server 1104 acquires accounting information, server-based gaming information, and a list of reports from the accounting application

1108, server-based gaming application 1110, and reporting application 1112, respectively.

At stage seven, the manager server 1104 uses the acquired information and configuration selections to create the requested content (see stage one). For example, the manager server 1104 can use the acquired information and configuration settings to build a web page, which when rendered, results in the manager 1102 operating according to the configuration selections. At stage eight, the manager 1102 receives and displays the manager 1102.

Example Wagering Game Machines

Example Wagering Game Machine Architecture

Figure 12:
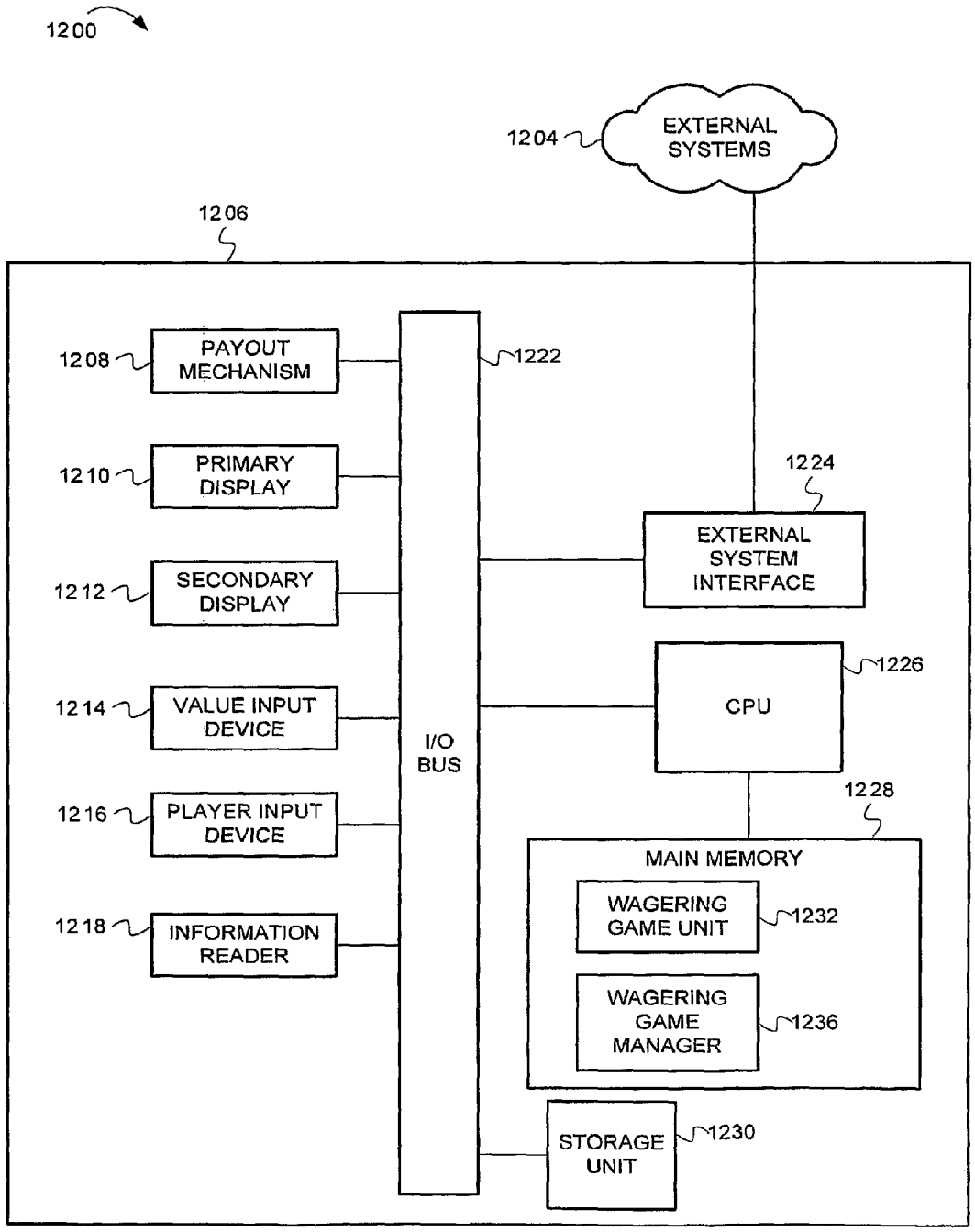
FIG. 12 is a block diagram illustrating a wagering game machine architecture, according to example embodiments of the invention.

FIG. 12 is a block diagram illustrating a wagering game machine architecture, according to example embodiments of the invention. As shown in FIG. 12, the wagering game machine 1206 includes a central processing unit (CPU) 1226 connected to main memory 1228, which includes a wagering game presentation unit 1232 and wagering game manager 1236. In one embodiment, the wagering game presentation unit 1232 can present wagering games, such as video poker, video blackjack, video slots, video lottery, etc., in whole or part. In one embodiment, the wagering game manager 1236 can acquire content and/or services from a plurality of remote application servers and present the content/services in its application interface.

The CPU 1226 is also connected to an input/output (I/O) bus 1222, which facilitates communication between the wagering game machine's components. The I/O bus 1222 is connected to a payout mechanism 1208, primary display 1210, secondary display 1212, value input device 1214, player input device 1216, information reader 1218, and storage unit 1230. The player input device 1216 can include the value input device 1214 to the extent the player input device 1216 is used to place wagers. The I/O bus 1222 is also connected to an external system interface 1224, which is connected to external systems 1204 (e.g., wagering game networks).

In one embodiment, the wagering game machine 1206 can include additional peripheral devices and/or more than one of each component shown in FIG. 12. For example, in one embodiment, the wagering game machine 1206 can include multiple external system interfaces 1224 and multiple CPUs 1226. In one embodiment, any of the components can be integrated or subdivided. Additionally, in one embodiment, the components of the wagering game machine 1206 can be interconnected according to any suitable interconnection architecture (e.g., directly connected, hypercube, etc.).

In one embodiment, any of the components of the wagering game machine 1206 (e.g., the wagering game presentation unit 1232) can include hardware, firmware, and/or software for performing the operations described herein. Machine-readable media includes any mechanism that provides (i.e., stores and/or transmits) information in a form readable by a machine (e.g., a wagering game machine, computer, etc.). For example, tangible machine-readable media includes read only memory (ROM), random access memory (RAM), magnetic disk storage media, optical storage media, flash memory machines, etc. Machine-readable media also includes any media suitable for transmitting software over a network.

Example Wagering Game Machine

Figure 13:
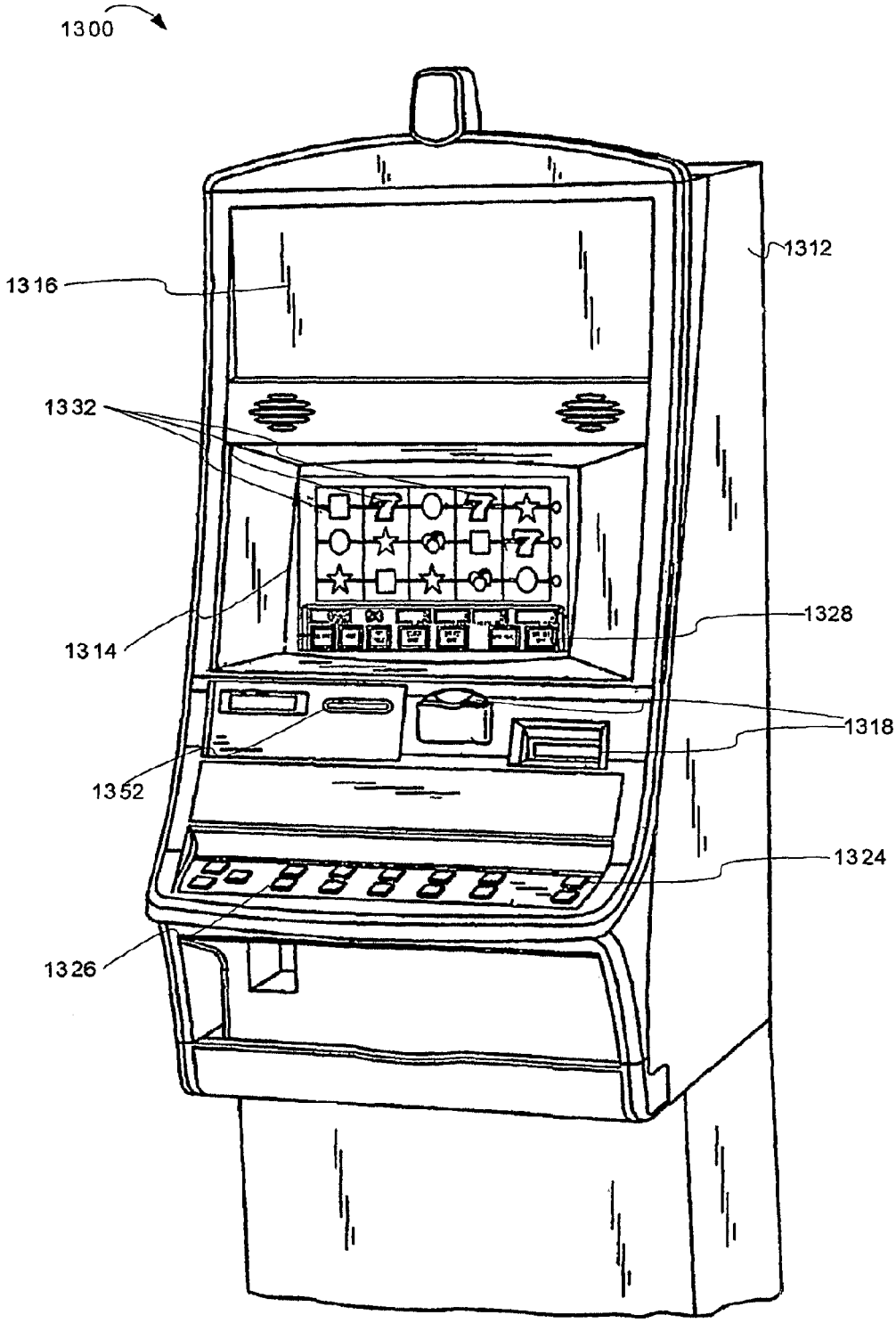
FIG. 13 is a perspective view of a wagering game machine, according to example embodiments of the invention.

FIG. 13 is a perspective view of a wagering game machine, according to example embodiments of the invention. Referring to FIG. 13, a wagering game machine 1300 is used in gaming establishments, such as casinos. According to embodiments, the wagering game machine 1300 can be any type of wagering game machine and can have varying structures and methods of operation. For example, the wagering game machine 1300 can be an electromechanical wagering game machine configured to play mechanical slots, or it can be an electronic wagering game machine configured to play video casino games, such as blackjack, slots, keno, poker, blackjack, roulette, etc.

The wagering game machine 1300 comprises a housing 1312 and includes input devices, including value input devices 1318 and a player input device 1324. For output, the wagering game machine 1300 includes a primary display 1314 for displaying information about a basic wagering game. The primary display 1314 can also display information about a bonus wagering game and a progressive wagering game. The wagering game machine 1300 also includes a secondary display 1316 for displaying wagering game events, wagering game outcomes, and/or signage information. While some components of the wagering game machine 1300 are described herein, numerous other elements can exist and can be used in any number or combination to create varying forms of the wagering game machine 1300.

The value input devices 1318 can take any suitable form and can be located on the front of the housing 1312. The value input devices 1318 can receive currency and/or credits inserted by a player. The value input devices 1318 can include coin acceptors for receiving coin currency and bill acceptors for receiving paper currency. Furthermore, the value input devices 1318 can include ticket readers or barcode scanners for reading information stored on vouchers, cards, or other tangible portable storage devices. The vouchers or cards can authorize access to central accounts, which can transfer money to the wagering game machine 1300.

The player input device 1324 comprises a plurality of push buttons on a button panel 1326 for operating the wagering game machine 1300. In addition, or alternatively, the player input device 1324 can comprise a touch screen 1328 mounted over the primary display 1314 and/or secondary display 1316.

The various components of the wagering game machine 1300 can be connected directly to, or contained within, the housing 1312. Alternatively, some of the wagering game machine's components can be located outside of the housing 1312, while being communicatively coupled with the wagering game machine 1300 using any suitable wired or wireless communication technology.

The operation of the basic wagering game can be displayed to the player on the primary display 1314. The primary display 1314 can also display a bonus game associated with the basic wagering game. The primary display 1314 can include a cathode ray tube (CRT), a high resolution liquid crystal display (LCD), a plasma display, light emitting diodes (LEDs), or any other type of display suitable for use in the wagering game machine 1300. Alternatively, the primary display 1314 can include a number of mechanical reels to display the outcome. In FIG. 13, the wagering game machine 1300 is an "upright" version in which the primary display 1314 is oriented vertically relative to the player. Alternatively, the wagering game machine can be a "slant-top" version in which the primary display 1314 is slanted at about a thirty-degree angle toward the player of the wagering game machine 1300. In yet another embodiment, the wagering game machine 1300 can exhibit any suitable form factor, such as a free standing model, bartop model, mobile handheld model, or workstation console model.

A player begins playing a basic wagering game by making a wager via the value input device 1318. The player can initiate play by using the player input device's buttons or touch screen 1328. The basic game can include arranging a plurality of symbols along a payline 1332, which indicates one or more outcomes of the basic game. Such outcomes can be randomly selected in response to player input. At least one of the outcomes, which can include any variation or combination of symbols, can trigger a bonus game.

In some embodiments, the wagering game machine 1300 can also include an information reader 1352, which can include a card reader, ticket reader, bar code scanner, RFID transceiver, or computer readable storage medium interface. In some embodiments, the information reader 1352 can be used to award complimentary services, restore game assets, track player habits, etc.

General

In the following detailed description, reference is made to specific examples by way of drawings and illustrations. These examples are described in sufficient detail to enable those skilled in the art to practice the inventive subject matter, and serve to illustrate how the inventive subject matter can be applied to various purposes or embodiments. Other embodiments are included within the inventive subject matter, as logical, mechanical, electrical, and other changes can be made to the example embodiments described herein. Features or limitations of various embodiments described herein, however essential to the example embodiments in which they are incorporated, do not limit the inventive subject matter as a whole, and any reference to the invention, its elements, operation, and application are not limiting as a whole, but serve only to define these example embodiments. The following detailed description does not, therefore, limit embodiments of the invention, which are defined only by the appended claims.

Each of the embodiments described herein are contemplated as falling within the inventive subject matter, which is set forth in the following claims.

The invention claimed is:

1. A method of requesting and displaying gaming machine information using a wagering game manager displayed via a graphical user interface, the method comprising:

receiving, from a user via at least one input device, a first request to configure the wagering game manager for display via the graphical user interface (GUI), wherein the first request is associated with a user identifier;

transmitting, to a game manager server, a second request for wagering game manager configuration options associated with the user identifier, wherein the wagering game manager configuration options determine wagering game manager content including one or more separate modules providing information about services available from one or more application servers;

receiving, from the game manager server, the requested configuration options and displaying the requested configuration options to the user;

receiving, from the user via the at least one input device, one or more configuration option selections;

obtaining wagering game information and module placement information for the one or more separate modules as determined by the selected configuration options;

generating wagering game manager content based on the placement information, the wagering game information, and the one or more separate modules; and displaying, via the GUI on at least one display device, the generated wagering game manager content.

2. The method of claim 1, further comprising:

transmitting the configuration option selections to a remote server for storage.

3. The method of claim 1, wherein the configuration options can differ based on the user identifier.

4. The method of claim 1, wherein the configuration options are included in a web page.

5. The method of claim 1, wherein the configuration options include content obtained from different ones of the plurality of application servers.

6. The method of claim 1, wherein the services include at least one of the services selected from the group consisting of wagering game machine monitoring services, wagering game machine configuration services, player tracking services, event tracking services, wagering game machine accounting services, licensing services, progressive jackpot services, and wagering game content distribution services.

7. The method of claim 1, wherein the configuration options include one or more configuration options selected from the group consisting of available services, module placement, color options, text options, and periodic update options.

8. The method of claim 1, wherein the receiving and presenting configuration options includes presenting a configuration wizard.

9. A machine-readable, non-transitory medium including instructions that, the instructions, when executed by a gaming system, cause the gaming system to perform a method including:

receiving, via at least one input device, a request to launch a wagering game manager, the request including a user identifier;

providing, via one or more display devices, configuration options associated with the user identifier;

receiving, via the at least one input device, one or more configuration option selections;

determining, based on the one or more configuration option selections, a set of modules and module placement information;

obtaining wagering game manager content, wherein some of the content originates from one or more remote application servers, wherein the content includes wagering game machine information for each of the modules of the set of modules; and displaying, via at least one display device, the wagering game manager content based on the wagering game machine information, the placement information, and the set of modules.

10. The machine-readable medium of claim 9, wherein the content is included in a web page.

11. The machine-readable medium of claim 9, wherein the configuration option selections are represented in hypertext markup language.

12. The machine-readable medium of claim 9, wherein wagering game machine information includes information about one or more of wagering game players, wagering game machine meters, wagering game events, and wagering game machine reports.

13. The machine-readable medium of claim 9, wherein the configuration option selections define one or more of the group consisting of available services, module placement, color options, text options, and periodic update options.

14. A gaming system comprising:

a configuration data store configured to store configuration selections associated with a wagering game manager, wherein the configuration selections are also associated with a user identifier; and a wagering game manager server configured to:

determine and present configuration options associated with the user identification;

receive the configuration selections:

receive the user identification and a request for content associated with the user identification, wherein the content is determined in part by the configuration selections;

determine, based on the configuration selections, a set of modules and module placement information;

obtain wagering game machine information for each of modules of the set; and generate the content based on the placement information, the wagering game information, and the set of modules.

15. The system of claim 14, wherein the configuration selections define panes in which the modules are to appear.

16. The system of claim 14, wherein the configuration selections include a module selections and module placement information.

17. The system of claim 14, wherein the content includes modules and information obtained from remote application servers.

* * * * *

UNITED STATES PATENT AND TRADEMARK OFFICE

CERTIFICATE OF CORRECTION

PATENT NO. : 8,172,686 B2
APPLICATION NO. : 12/293998
DATED : May 8, 2012
INVENTOR(S) : Terry D. Warkentin It is certified that error appears in the above-identified patent and that said Letters Patent is hereby corrected as shown below:

On Sheet 11 of 13, Figure 11, line 8, delete "CONFIGURATOIN" and insert -- CONFIGURATION --, therefor.

In column 10, line 10, after "poker," delete "blackjack,".

In column 12, line 27, in Claim 9, after "that," delete "the instructions,".

Signed and Sealed this
Thirty-first Day of July, 2012

David J. Kappos

David J. Kappos
*Director of the United States Patent and Trademark Office*